United States Patent [19]

Pfeifer

[11] Patent Number: 5,044,351

[45] Date of Patent: Sep. 3, 1991

[54] SHOCK ABSORBER FOR SPORTING AND HUNTING BOWS

[75] Inventor: Anton Pfeifer, Furth i. Wald, Fed. Rep. of Germany

[73] Assignee: Amerika-Bogen-Handelsgesellschaft mbH, Duisburg, Fed. Rep. of Germany

[21] Appl. No.: 469,596

[22] PCT Filed: Jul. 20, 1989

[86] PCT No.: PCT/EP89/00854

§ 371 Date: Mar. 27, 1990

§ 102(e) Date: Mar. 27, 1990

[87] PCT Pub. No.: WO90/02307

PCT Pub. Date: Mar. 8, 1990

[30] Foreign Application Priority Data

Aug. 17, 1988 [DE] Fed. Rep. of Germany ..... 3827934
Jul. 11, 1989 [DE] Fed. Rep. of Germany ..... 3922805

[51] Int. Cl.[5] ..... F41B 5/00
[52] U.S. Cl. ..... 124/89; 42/1.06
[58] Field of Search ..... 124/86, 88, 89, 23.1, 124/25.6; 42/1.06

[56] References Cited

U.S. PATENT DOCUMENTS

| | | | |
|---|---|---|---|
| 3,412,725 | 11/1968 | Hoyt, Jr. | 124/89 |
| 3,524,441 | 8/1970 | Jeffery | 124/89 |
| 3,752,142 | 8/1973 | Morita et al. | 124/89 |
| 4,570,608 | 2/1986 | Masterfield | 124/89 |
| 4,660.538 | 4/1987 | Burgard | 124/89 |
| 4,779,602 | 10/1988 | Hess, Sr. | 124/89 |
| 4,893,606 | 1/1990 | Sisko | 124/89 |
| 4,945,666 | 8/1990 | Henry et al. | 124/89 X |
| 4,982,719 | 1/1991 | Haggard et al. | 124/89 |
| 4,986,018 | 1/1991 | McDonald, Jr. | 124/89 X |

FOREIGN PATENT DOCUMENTS

| | | | |
|---|---|---|---|
| 2538490 | 3/1977 | Fed. Rep. of Germany | 124/89 |
| 2575817 | 7/1986 | France | 124/89 |
| 1296201 | 11/1972 | United Kingdom | 124/89 |

*Primary Examiner*—Randolph A. Reese
*Assistant Examiner*—Jeffrey L. Thompson
*Attorney, Agent, or Firm*—Townsend and Townsend

[57] ABSTRACT

A hydraulic or pneumatic shock-absorber for sporting and hunting bows is fitted, as a connecting element, between a stabilizing counterweight (spinner) and the bow in such a manner as to permit, between the counterweight and the bow, a movement which is damped in the direction of the shot, although the counterweight is secured rigidly to the bow vertically and horizontally to the direction of the shot. This leads to smoother launching of the arrow and to marked accuracy.

11 Claims, 2 Drawing Sheets

SHOCK ABSORBER FOR SPORTING AND HUNTING BOWS

The invention relates to a shock-absorber for sporting and hunting bows.

It has hitherto been customary to fit counterweights or directional stabilizers to the bow by means of rubber bearings acting as vibration dampers. during aiming and shooting, however, this does not prevent the bow from being disturbed by inadequate damping and inherent stability of the rubber bearings.

The purpose of this invention is to reduce the aiming and shooting problems by means of improved shock-absorber.

According to the invention, this is accomplished by means of a shock-absorber for sporting and hunting bows, comprising a counterweight which is fitted to the bow by means of a hydraulic or pneumatic shock-absorber.

Preferably the counterweight consists of a V-bar. The V-bar generally consists of a front bar which is attached to the bow in the direction of the shot and a bifurcated bar attached to the back side of the bow. Weighing elements can then be attached to the ends of the front bar and the bifurcated bar.

The shock-absorber may be fitted to the bow by means of a hydraulic or pneumatic shock-absorber. The shock-absorber is preferably fitted in such a manner that the piston-rod is secured to the bow in the direction of the shot and that the counterweight, in the form of a conventional V-bar, is fitted to the damperhousing. The hydraulic or pneumatic damper makes it possible to fit the stabilizing weights to the bow in such a manner as to permit damped movement between, the weights and the bow during shooting, although the said weights act as though they were mounted "rigidly" horizontally and vertically to the direction of the shot. This provides the highest possible aiming and shooting accuracy, in conjunction with damping in the direction of the shot. As a result of this, the energy remaining in the bow is absorbed as soon as the arrow is released, and the shock of the release is considerably reduced.

In the case of hunting bows in particular, the damper-housing itself may form the counter- or stabilizing weight, or the latter may be in the form of a short stabilizer.

The hitherto usual rubber bearings are no longer necessary or may be made hard. This provides the advantage of complete aiming stability, i.e. stabilizer-vibration during aiming, arising from soft rubber bearings, is eliminated.

Figure 1:
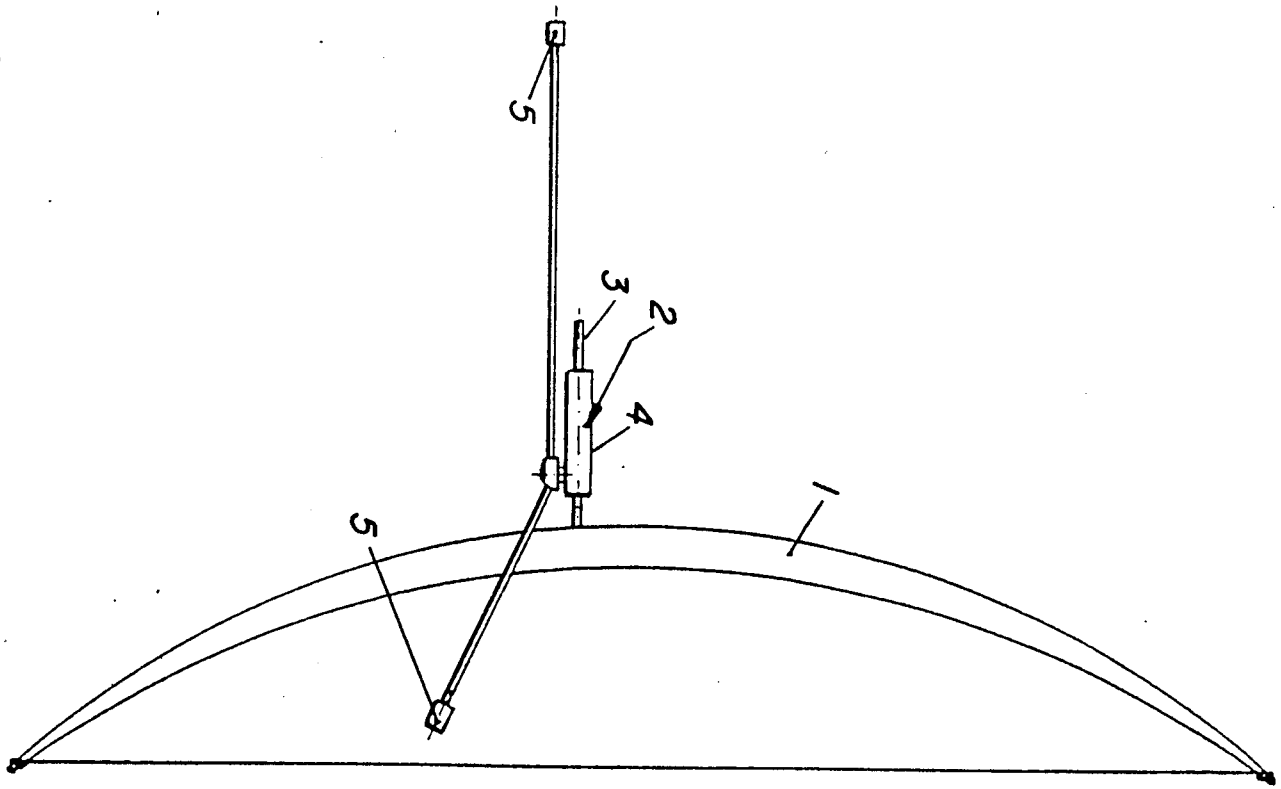
Figure 2:
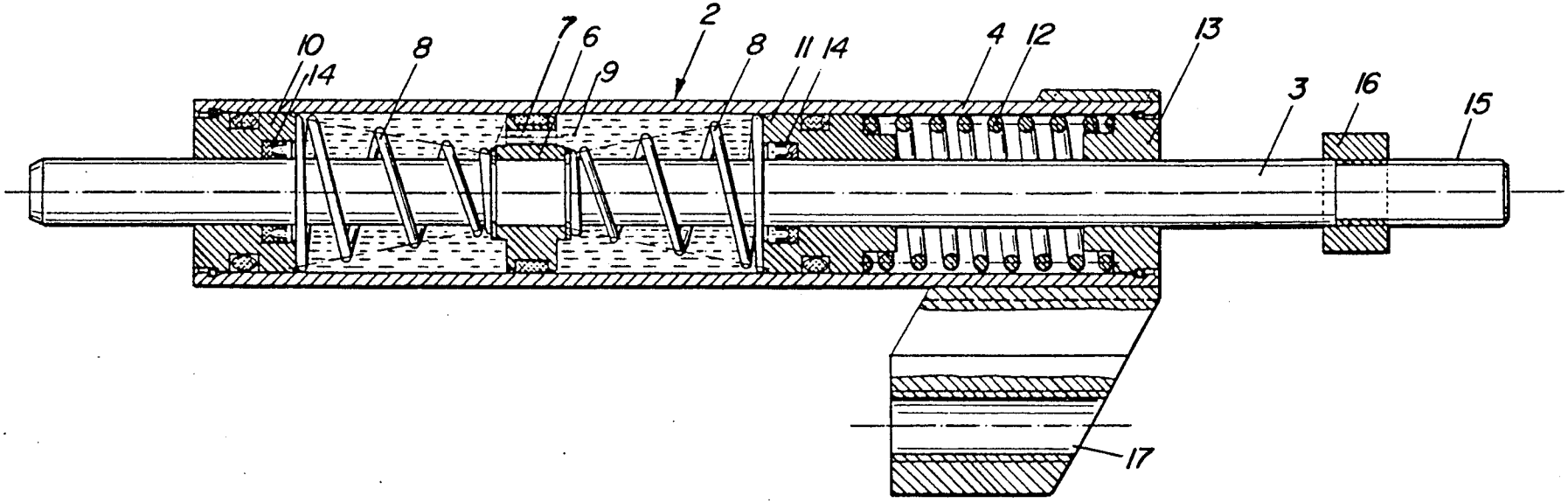

The invention is described in greater detail hereinafter in conjunction with the drawings attached hereto, wherein:

FIG. 1 is a diagrammatical side elevation of a bow with the shock-absorber fitted; and FIG. 2 is an axial cross-section through the hydraulic shock-absorber in FIG. 1, to an enlarged scale.

A hydraulic shock-absorber 2 is fitted to bow 1, shown in FIG. 1, in such a manner that piston-rod 3 points in the direction of the shot. Secured to housing 4 of shock-absorber 2 is a conventional stabilizing counterweight 5 which, in this example of embodiment, is in the form of a so-called V-bar.

As shown in FIG. 2, piston-rod 3 of shock-absorber 2 is provided with a piston 6. In the design shown in FIG. 2, shock-absorber 2 is in the form of a single-tube damper. Arranged in piston 6 are one or more passages 7 which serve to connect oil-chambers 9 located on each side of piston 6. Oil-chambers 9 are closed off by means of plugs 10, 11, plug 10 being secured to housing 4 whereas plug 11 is adapted to move along piston-rod 3 and acts as a separating piston. Arranged between plug 10 and piston 6, and between piston 6 and plug 11, are springs 8 which keep piston 6 centred. Arranged at the opposite end of housing 4 is a plug 13. Arranged between plug 13 and axially displaceable plug 11 is a preloading spring 12. Plugs 10 and 11 are sealed off from piston-rod 3 by expanding-ring seals 14 actuated by oilpressure.

One end of piston-rod 3 is provided with a thread 15 and a lock-nut 16 for attachment to the bow. Stabilizing counterweight 5 is adapted to be inserted, in parallel with piston-rod 3, into a sleeve 17 fitted to housing 4.

Shock-absorber 2 causes the vibration-energy of the mass of bow 1 to be transferred, through piston-rod 3, to piston 6 which slides in the housing which is connected to a hydraulic medium, preferably oil, and to stabilizing counterweight 5. When deflected, piston 6 forces oil through passages 7 into the other oil-chamber 9. Depending upon the speed at which the oil is displaced - the said speed being determined by the diameter of the passage and the viscosity of the hydraulic medium - more or less damping is produced. Hydraulic shock-absorber 2 has a so-called progressive characteristic curve, i.e. it can adapt itself to the relevant load. The greater the tension-weight of bow 1, and thus the amount of residual energy, the greater the damping action. Hydraulic shock-absorber 2 absorbs the residual energy almost completely and destroys it, converting it, by internal friction, directly into heat. This damping unloads the whole system and increases the life of the bow, since the centerpiece and ejector-arm of the bow are protected from material-fatiguing stress-waves and the relevant threaded connection, e.g. for the sighting device, "button" and transverse stabilizers are protected from inadvertent loosening as a result of vibration.

Hydraulic shock-absorber 2, described in the example of embodiment, may be replaced by a pneumatic damper. According to another modification, housing 4 may be designed as the counterweight, especially for hunting bows.

The embodiments of the invention in which an exclusive property or privilege is claimed are defined as follows:

1. A shock-absorber for sporting and hunting bows, comprising a fluid shock-absorber having a housing, a piston moveable within the housing and a piston rod carrying the piston and adapted to be attached to the bow to extend in the direction of the shot so that shock and vibrations generated by the bow upon its release during use are counteracted and dampened, and a counterweight for the bow in the form of a V-bar fitted to the housing.

2. A shock absorber according to claim 1, wherein the shock absorber includes first and second plugs closing an interior space of the housing, and a pair of springs disposed in the space, placed between the piston and closing plugs, and arranged so that the springs urge the piston into a center position.

3. A shock absorber according to claim 2, wherein one of the plugs is axially moveable within the housing intermediate an end thereof and the piston and including a preloaded spring between the moveable plug and the end of the housing urging the movable plug towards the fluid in the space.

4. A shock absorber according to claim 1 including a sleeve secured to the housing and oriented parallel to the piston rod, and wherein the counterweight is attached to the sleeve.

5. A shock absorber for sporting and hunting bows comprising:

a piston rod having an end adapted to be affixed to the bow so that the rod extends in the shooting direction of the bow;

a tubular housing disposed about the rod and axially movable relative thereto, the housing including a sealed chamber through which the rod extends, the chamber being filled with a fluid; and a piston disposed in the chamber, fixed to the rod and axially movable relative to the housing, the piston including means permitting fluid flow from one side of the piston to the other;

whereby shock and vibrations generated by the bow upon the release of an arrow cause relative axial movements between, and are reduced and dampened by the housing, the piston and the fluid.

6. A shock absorber according to claim 5, including a counterweight operatively coupled with the housing.

7. A shock absorber according to claim 6 wherein the housing forms the counterweight.

8. A shock absorber according to claim 6 including a counterweight defined by an elongated bar and a sleeve attached to the housing and mounting the elongated bar substantially parallel to the rod.

9. A shock absorber according to claim 5 including spring means in the chamber between the piston and ends of the chamber for substantially centering the chamber relative to the piston.

10. A shock absorber according to claim 5 wherein at least one end of the housing extends past the chamber and including a sealing plug axially movably carried by the rod and sealing the chamber proximate the at least one end of the housing, and spring means operatively coupled with the housing and urging the plug towards the fluid in the chamber.

11. A shock absorber for sporting and hunting bows, comprising a fluid actuator including a tubular housing having an interior chamber filled with fluid and sealed to the exterior, a rod extending through the chamber having an end adapted to be secured to the bow, a piston fixed to the rod and disposed in the chamber permitting relative movements between the rod and the chamber and the housing, a plug forming one end of the chamber, sealing the chamber and axially movable relative to the housing and the rod, and means disposed in the housing for applying an axial force to the plug to urge it toward the fluid in the chamber.

* * * * *